US010021476B2

(12) United States Patent
Kolton

(10) Patent No.: US 10,021,476 B2
(45) Date of Patent: Jul. 10, 2018

(54) EARPHONE WITH INTERCHANGEABLE HOUSING

(71) Applicant: Timothy Val Kolton, Arlington, TX (US)

(72) Inventor: Timothy Val Kolton, Arlington, TX (US)

( * ) Notice: Subject to any disclaimer, the term of this patent is extended or adjusted under 35 U.S.C. 154(b) by 0 days.

(21) Appl. No.: 14/551,079

(22) Filed: Nov. 24, 2014

(65) Prior Publication Data

US 2016/0066079 A1 Mar. 3, 2016

Related U.S. Application Data

(63) Continuation-in-part of application No. 14/469,557, filed on Aug. 26, 2014.

(51) Int. Cl.
*H04R 1/10* (2006.01)

(52) U.S. Cl.
CPC ..... *H04R 1/1058* (2013.01); *H04R 1/10* (2013.01); *H04R 1/105* (2013.01); *H04R 1/1016* (2013.01); *H04R 1/1091* (2013.01); *H04R 2201/103* (2013.01)

(58) Field of Classification Search
CPC ..... H04R 1/10; H04R 1/1008; H04R 1/1016; H04R 1/105; H04R 1/1058; H04R 1/1066; H04R 1/1075; H04R 5/033; H04R 5/027; H04R 5/0335; H04R 2205/024; H04R 2201/103; H04R 2205/022; H04R 2420/07
USPC ..... 381/358, 367, 370, 371, 374, 375
See application file for complete search history.

(56) References Cited

U.S. PATENT DOCUMENTS

| | | | | |
|---|---|---|---|---|
| 5,581,627 | A * | 12/1996 | Bowser | H04R 5/0335 381/189 |
| 6,741,718 | B1 * | 5/2004 | Brumitt | H04R 1/1016 379/430 |
| 6,760,458 | B1 * | 7/2004 | Bogeskov-Jensen | H04M 1/05 381/370 |
| 8,693,721 | B2 * | 4/2014 | Chen | H04R 1/1083 381/370 |
| 8,744,111 | B2 * | 6/2014 | Chu | H04R 1/1091 381/370 |
| 9,538,275 | B2 * | 1/2017 | Lee | H04R 1/1033 |
| 2002/0090104 | A1 * | 7/2002 | Ma | H04R 1/1091 381/374 |
| 2002/0131585 | A1 * | 9/2002 | Jones | H04M 1/05 379/431 |
| 2006/0098836 | A1 * | 5/2006 | Sabick | H04R 1/1016 381/380 |

(Continued)

*Primary Examiner* — Oyesola C Ojo
(74) *Attorney, Agent, or Firm* — Edwin Tarver

(57) ABSTRACT

A customizable headphone having a removable and interchangeable housing includes an earphone having a transducer for reproducing sound a sound port, and a body portion. A first housing sized to accommodate the body portion is coupled to and partially encloses the body portion using a resilient releasable connection without obstructing the sound port when affixed to the body portion. Upon biasing the first housing to separate from the body portion, the first housing may be fully removed and replaced with a second housing with a different appearance and characteristics. The releasable connection may include a retaining ring coupled to the body portion in a channel to engage the interior of a housing in a pressure fit.

20 Claims, 18 Drawing Sheets

(56) References Cited

U.S. PATENT DOCUMENTS

| | | | | |
|---|---|---|---|---|
| 2008/0075316 | A1* | 3/2008 | Chan | H04R 1/105 381/381 |
| 2008/0279409 | A1* | 11/2008 | Hupkes | H04R 1/1066 381/370 |
| 2009/0136074 | A1* | 5/2009 | Chang | H04R 1/06 381/380 |
| 2009/0252366 | A1* | 10/2009 | Johnson | H04R 1/1091 381/380 |
| 2009/0285436 | A1* | 11/2009 | Lowry | H04R 1/1016 381/380 |
| 2011/0255729 | A1* | 10/2011 | Tan | H04R 1/105 381/380 |
| 2011/0317864 | A1* | 12/2011 | Kaneko | H04R 1/1066 381/380 |
| 2013/0108069 | A1* | 5/2013 | Lee | H04R 1/1033 381/74 |
| 2014/0334658 | A1* | 11/2014 | Wang | B29C 45/14639 381/381 |
| 2015/0382123 | A1* | 12/2015 | Jobani | H04R 1/1016 700/98 |

* cited by examiner

EARPHONE WITH INTERCHANGEABLE HOUSING

This application is continuation in part of U.S. application Ser. No. 14/469,557, filed on Aug. 26, 2014.

BACKGROUND

Personal audio sound reproduction equipment is well known in the art, including both over-ear external headphones typically employing a headband or similar support structure and smaller in-ear earphones usually inserted into a user's ear canal. Due to diminished size and weight, relative ease of manufacture at lower cost, and with an audio fidelity equal to or better than headphones, earphones are frequently preferred over headphones for everyday use and are particularly suited for travel, when engaging in sports activities or during any activity for which headphones are disfavored.

Users desire earphones to be suited for a particular purpose (e.g., when jogging, bike riding, or during other sports) as well as harmonize aesthetically with attire and accessories (e.g., watches, jewelry, eyeglasses, etc.). For this reason users frequently purchase multiple sets of earphones to suit individual activities. Owning multiple sets is both, expensive and impractical. Purchasing multiple over-ear headphones is likewise cost prohibitive Earphones have evolved into a wide variety of body designs, including variations in shape, color, and comprise a wide variety of materials. While purchasing multiple earphones is preferred over purchasing multiple headphones, coordinating, managing, and organizing numerous earphones is a problem. Keeping track of many individual earphone sets is difficult as they are frequently inadvertently lost and have a tendency to tangle if two or more sets are stored together.

Another problem with maintaining numerous sets of differently shaped earphones is the redundancy of their common parts. While a variety of external designs may be desired, the plugs, wires, transducers and other internal components are unnecessarily duplicated.

There is therefore a need for an earphone capable of a wide variety of external designs having a single operational set of wires, plug, and earphone body. The need also exists for an earphone allowing users to quickly and easily select and switch between different designs as desired. There is also a need for an earphone offering multiple designs that is easy to manufacture and therefore less expensive. These and other problems in the art are addressed by an earphone with an interchangeable housing as shown and described in the following summary, description, and claims.

SUMMARY

A customizable earphone having a removable and interchangeable housing, allowing users to change the outward appearance of the earphone includes an earphone or set of earphones having a transducer for reproducing sound. Each earphone has two main components, a body portion and a nozzle portion extending from the body portion. Preferably, the nozzle portion includes a sound port for transmitting sound produced by the transducer to the user's ear. In addition to the body portion and the nozzle portion, the earphone includes a decorative housing. The decorative housing has an opening for accommodating the body portion, allowing a user to slide the body portion into the decorative housing.

The earphone also includes a releasable connection for affixing the decorative housing to the body portion, in order to hold the decorative housing onto the body portion while allowing the decorative housing to be easily removed in favor of installing a different decorative housing according to the user's preference. Preferably, the decorative housing encloses the body portion when affixed to the body portion, while leaving the nozzle portion exposed. This allows the customized portion of the earphone to be visible outside a user's ear, while permitting the customary fit of the earphone inside the user's ear.

If a user desires a different ornamentation for the earphone, such as to match clothing, jewelry or other attire, the user simply separates the decorative housing from the body portion by releasing the releasable connection and sliding the body portion from the opening of the decorative housing. Preferably, the nozzle portion will be fitted with a deformable tip, such as a conventional silicon earphone tip for inserting into a user's ear. The decorative housing is ideally shaped to rest adjacent the deformable tip when installed on the body portion, giving the illusion that the decorative housing is in fact the body portion of the earphone.

In order to ensure a smooth, releasable fit between the earphone and the deformable housing, and to aid in positioning the body portion within the deformable housing, the opening ideally closely matches the outer profile of the body portion. In one embodiment, the earphone may have a channel between the body portion and the nozzle portion. In such an arrangement, the decorative housing includes a lip at the opening designed to fit in the channel. Preferably the opening is sized to urge the lip into the channel under pressure when the body portion is inserted into the decorative housing.

In addition to the channel and lip releasable connection at the junction between the body portion and the nozzle portion of the earphone, the decorative housing also includes one or more stabilizing members on its interior. To prevent rocking or other undesirable movement of the body portion relative to the decorative housing, the stabilizing members are positioned to abut the body portion when fully inserted into the decorative housing and when the lip is engaged in the channel.

Since headphones, and in particular earphones, usually employ cabled connections between the earphone and a sound producing electronic device, the earphone may include a cable strain-relief extending from the body portion. The strain-relief is typically a rubber or similar resilient material sheathing the audio cable as it exits the body portion. To accommodate the strain-relief, the decorative housing preferably includes a slot extending from the opening. The slot is preferably sized and of a length that the cable strain-relief reaches the terminal end of the slot just as the lip of the opening seats in the channel on the body portion when the body portion is inserted into the decorative housing.

In order to use the earphone, an in-ear earphone is provided having a body portion and a nozzle portion. Also provided is a decorative housing and a connection between the earphone and the decorative housing. A user inserts the body portion through an opening on the decorative housing until the decorative housing is releasably affixed to the earphone and covers the body portion of the earphone. Preferably once the decorative housing is affixed to the earphone, the decorative housing is securely disposed adjacent the nozzle portion, giving the appearance that the decorative housing is, in fact, the body portion of the earphone. The earphone may then be inserted into the user's ear to listen to a desired audio.

When the user wishes to change the appearance of the earphone, the decorative housing is removed from the body portion. Typically, this is accomplished by sliding the body portion back through the opening, which may include sliding the strain-relief out of the slot adjacent the opening if a strain-relief is present. A new decorative housing may then be selected and inserted over the body portion. In various embodiments, multiple decorative housings may be provided with the earphone to offer users a wide variety of designs.

A second embodiment customizable earphone having a removable and interchangeable housing also includes an earphone having a transducer for reproducing sound, the earphone having a body portion, and having a nozzle portion extending from the body portion, wherein the nozzle portion comprises a sound port. Likewise, a decorative housing having an opening sized to accommodate the body portion is connected to the earphone using a releasable connection coupling the decorative housing to the body portion. Like the first embodiment, the decorative housing is enclosed the body portion without enclosing the nozzle portion when the decorative housing is affixed to the body portion, and upon releasing the releasable connection, the decorative housing separates from the body portion.

The second embodiment earphone may also include a retaining ring. The decorative housing is coupled to the body portion using the retaining ring in a pressure fit. In order to preserve the location of the retaining ring, a channel is located on the body portion for accommodating the retaining ring. Preferably the opening matches an outer profile of the body portion, preferably closely. The earphone also includes a cable strain-relief extending from the body portion. The decorative housing includes a slot extending from the opening that accommodates the cable strain relief.

In one embodiment, the decorative housing includes a second opening through which the body portion extends. In another embodiment, the decorative housing includes a sport fin extending from the decorative housing. The sport fin may extend in a direction opposite a cable strain relief. These and other embodiments are preferably included with the earphone when purchased, offering a user a wide selection of design choices for the earphone.

The earphone may also be defined as an in-ear earphone having a removable and interchangeable housing, including a body portion enclosing a transducer and having a cable strain-relief extending from the body portion. A nozzle portion, including a sound port configured to receive a deformable tip, extends from the body portion. A decorative housing having an opening sized to accommodate the body portion in a pressure fit, having a slot extending from the opening sized to accommodate the cable strain relief, and having a retaining ring encircles the body portion. The decorative housing is held against the retaining ring in a pressure fit, thereby anchoring the decorative housing to the body portion when the body portion is inserted into the decorative housing.

The body portion may also include a channel. Ideally, the channel is disposed on the body portion aft of the cable strain relief. When the decorative housing is fully inserted onto the body portion, the cable strain relief is ideally folly inserted in the slot.

In order to use the earphone with interchangeable housings, an in-ear earphone is provided having a body portion and a nozzle portion. A releasable connection is provided between the body portion and the nozzle portion, making them separable. A user then selects a decorative housing having an opening, inserts the body portion through the opening until the decorative housing is releasably affixed to the in-ear earphone covering the body portion and adjacent the nozzle portion, and inserts the in-ear earphone bearing the decorative housing in the user's ear.

Additional steps in the method may include removing the decorative housing from the in-ear earphone by sliding the body portion out of the opening, selecting a second decorative housing from among various different decorative housings, and sliding the second decorative housing over the body portion. Providing multiple decorative housings allows maximal customization.

REFERENCE NUMBERS

Initial Embodiment

Figure 1:
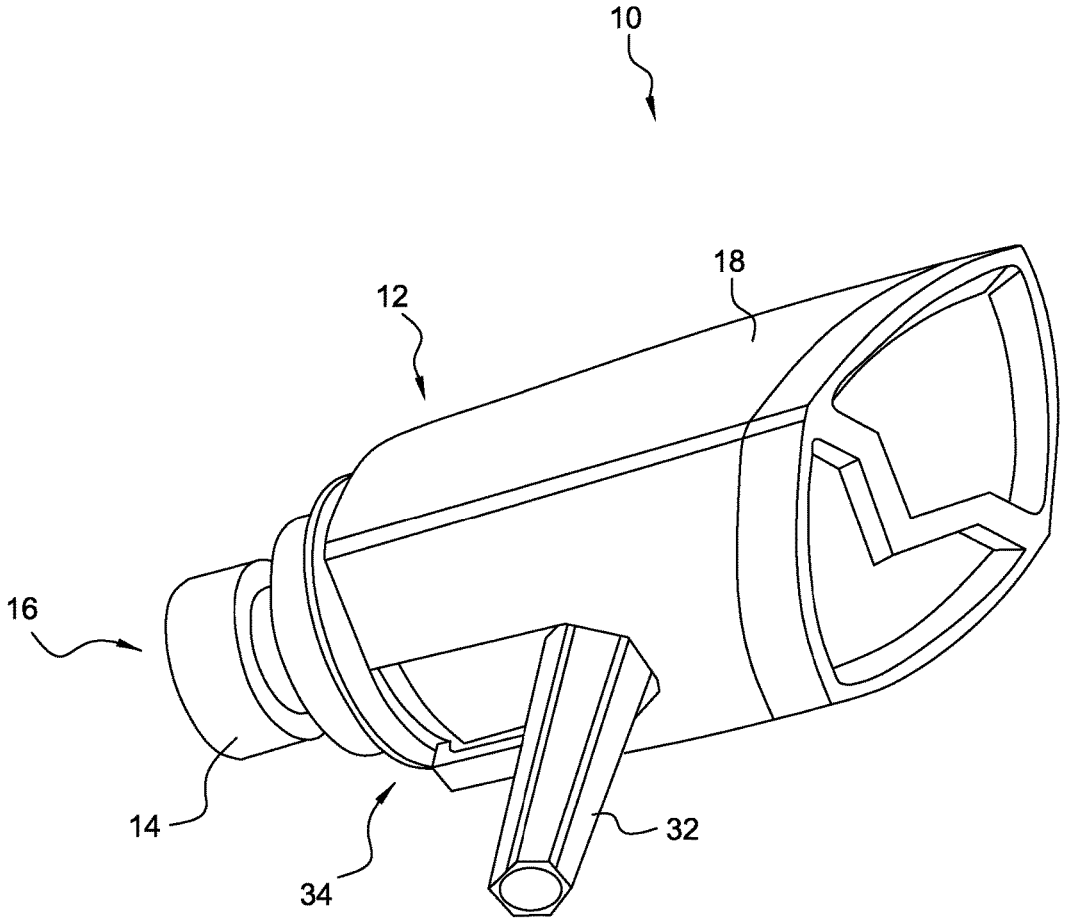
FIG. 1 is a perspective view of art earphone having an interchangeable housing installed thereon.

10. earphone
12. body portion
14. nozzle portion
16. sound port
18. decorative housing
20. opening

22. releasable connection
24. deformable tip
26. channel
28. lip
30. stabilizing member
32. cable strain-relief
34. slot
36. main portion
38. secondary portion
40. ear tip slot
42. ear tip
44. decorative indicia
45. logo Secondary Embodiment

100. earphone
102. body portion
104. cable
106. cable strain relief
108. sound port
110. ear tip
112. ear tip indicia
114. channel
116. back end
118. retaining ring
120. transducer
122. decorative housing
124. decorative housing indicia
126. sport fin interchangeable housing
128. sport housing
130. fin member
132. second embodiment decorative interchangeable housing
134. third embodiment decorative interchangeable housing
136. hollow backend
138. slot
140. dot
142. ear hook housing
142. ear hook housing
144. housing portion
146. ear hook member
148. anchor
150. slot
152. hollow end

DESCRIPTION

Referring to FIG. 1, an earphone 10 comprises a body portion 12 and decorative housing 18 covering the body portion 12. The earphone 10 also comprises a nozzle portion 14 not covered by the decorative housing 18. The nozzle portion 14 includes a sound port 16 through which sound is transmitted to the user. Also shown in this embodiment, the earphone 10 includes a cable strain-relief 32 extending from the body portion 12 and the decorative housing 18 includes a slot 34 for accommodating the cable strain-relief 32.

Figure 2:
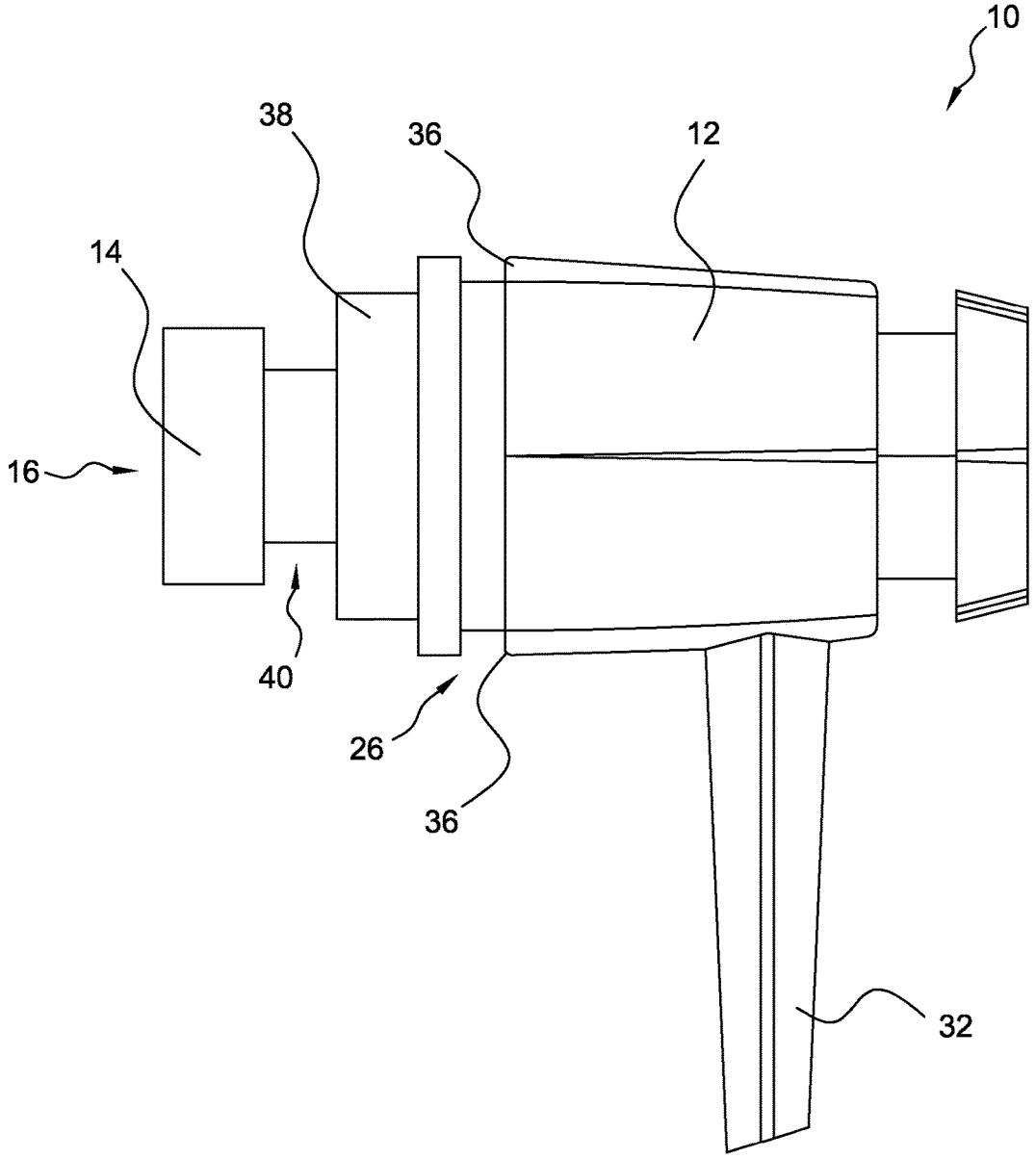
FIG. 2 is a left side view of the earphone without the housing.
Figure 3:
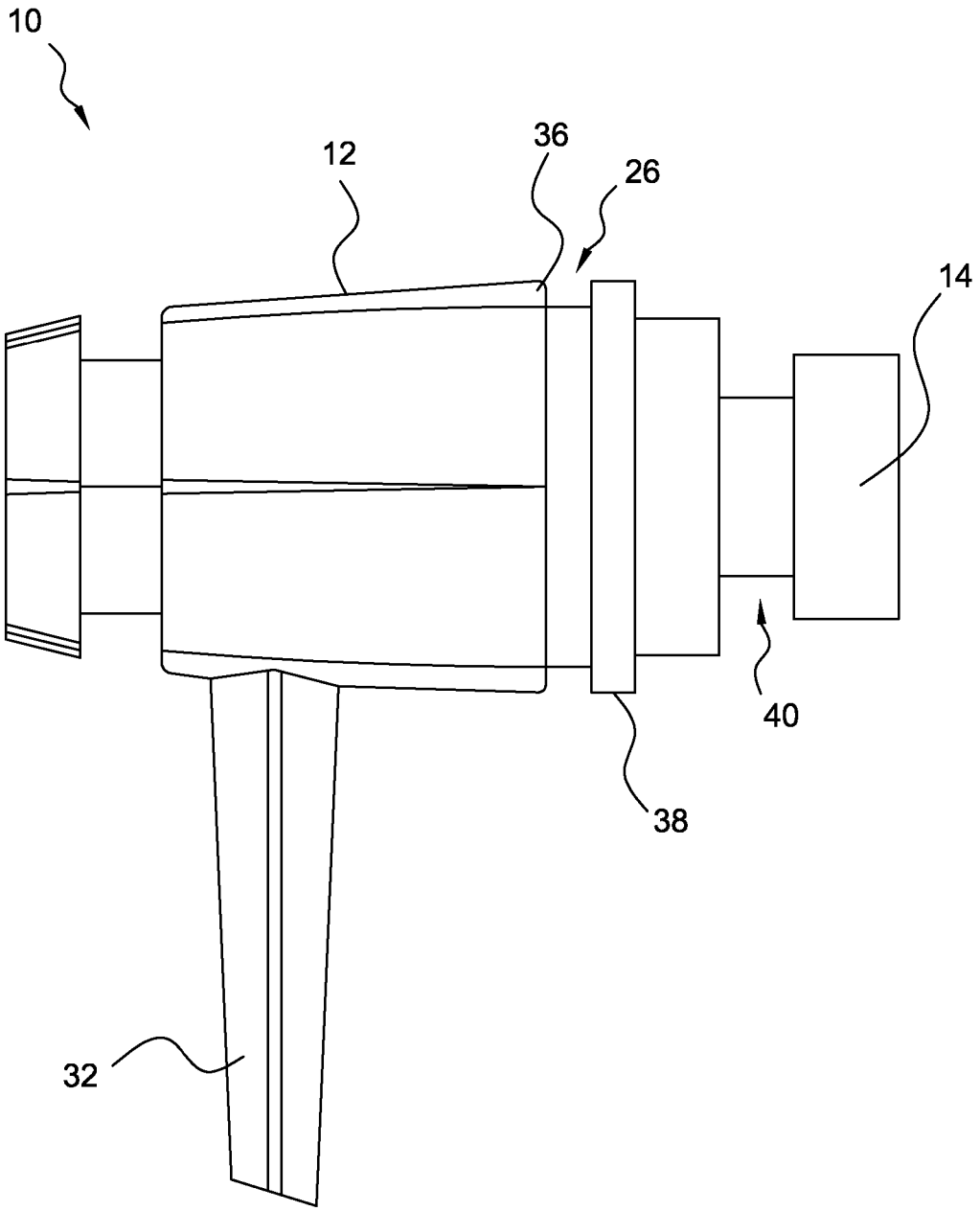
FIG. 3 is a right side view of the earphone without the housing.

Referring to FIGS. 2 and 3, side views of the earphone 10 are shown without the decorative housing 18 (not shown). The body portion 12 of the earphone 10 includes a main portion 36 and a secondary portion 38 with a channel 26 disposed between them. The channel 26 is used to hold the decorative housing 18 in position relative to the earphone 10 when installed thereon. The earphone 10 nozzle portion 14 has a sound port 16 for directing sound into a user's ear, and an ear tip slot 40 for accommodating an ear tip 42 (not shown) and affixing it to the nozzle portion 14.

Figure 4:
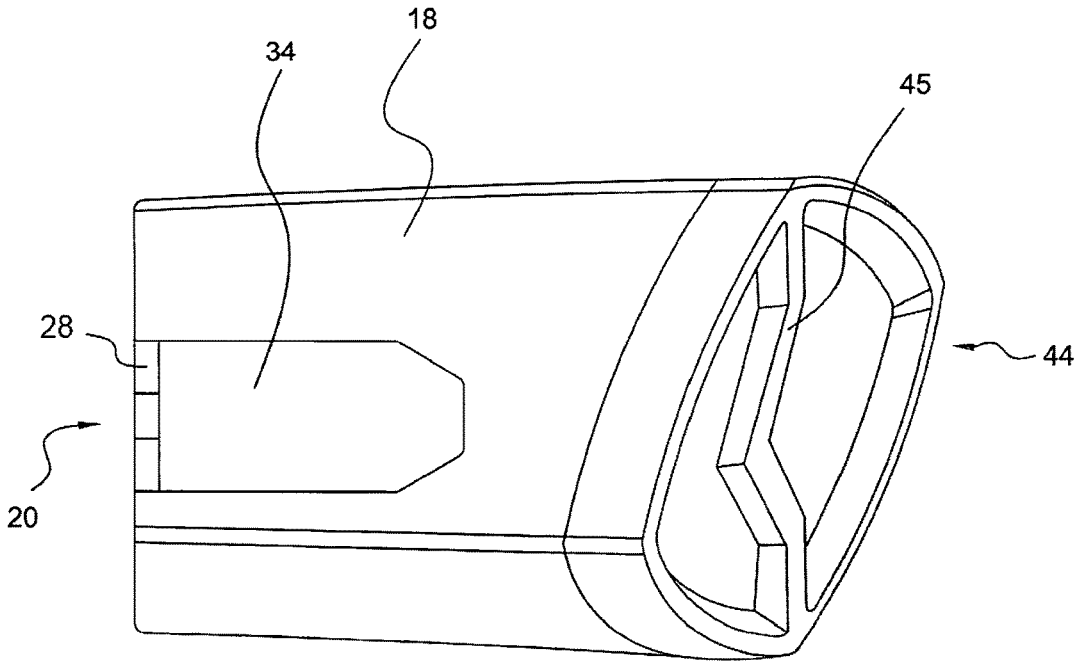
FIG. 4 is a bottom view of the housing.

Referring to FIG. 4, a bottom view of the decorative housing 18 is shown. The decorative housing 18 may have an ornamental shape, and in addition may include decorative indicia 44 such as a design or logo 45. One end of the decorative housing 18 includes an opening 20 for receiving the body portion 12 (not shown). A slot 34 extends from the opening 20, allowing a user to slide the cable strain-relief 32 (not shown) into decorative housing 18 as well. Preferably the slot 34 is sized so that when the body portion 12 is inserted fully into the decorative housing 18, the cable strain-relief 32 reaches the terminal end of the slot 34.

Still referring to FIG. 4, the opening 20 preferably includes a releasable connection adjacent the opening 20 for holding the body portion 12 relative to the decorative housing 18. In the illustrated embodiment, the releasable connection includes a lip 28, slightly deformable due to the presence of the slot 34, thin walls, and resilient material comprising the deformable housing 18. The lip 28 is sized to encounter the channel 26 (not shown) on the body portion 12, holding it in position. Preferably the lip 28 and opening 20 are opposite any logo 45 or indicia 44, thereby making them prominently visible when the earphone 10 with a decorative housing 18 installed on it is inserted into a user's ear.

Figure 5:
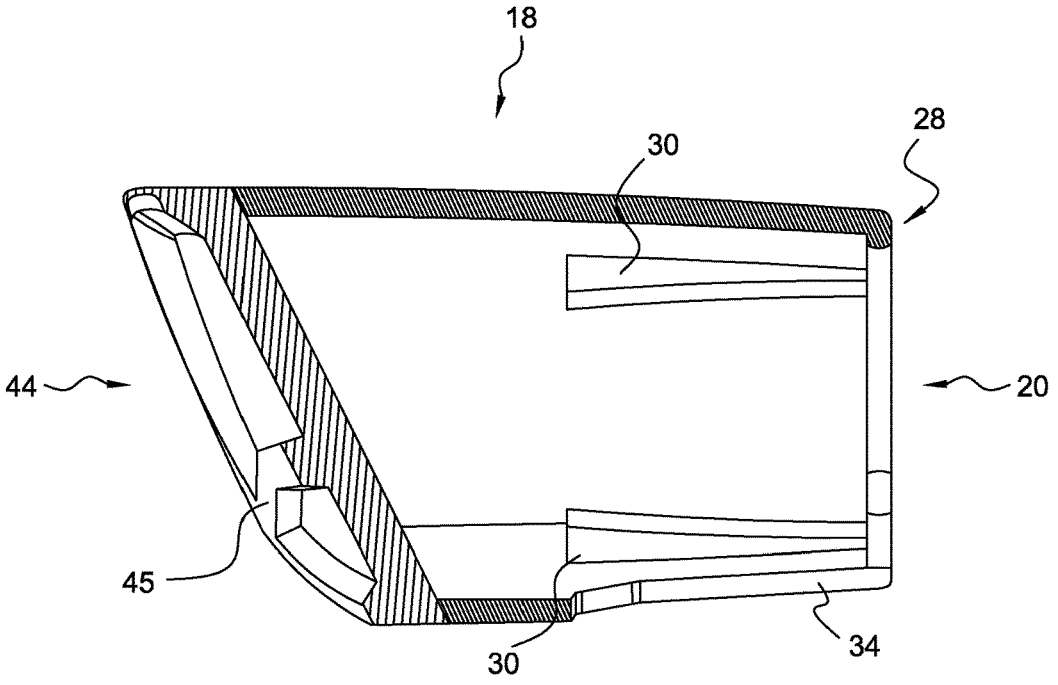
FIG. 5 is a cutaway view of the housing.

Referring to FIG. 5 a cutaway view of the decorative housing 18 shows its internal structure. Opposite the decorative indicia 44 and logo 45, the opening 20 bearing the lip 28 is shown. Inside the opening 20 is a series of stabilizing members 30 extending inward from the decorative housing 18. The stabilizing members 30 are shaped to conform to the body portion 12 (not shown). The stabilizing members 30 operate both as stops to prevent the body portion 12 from being inserted too deeply into the decorative housing 18, and to anchor the body portion 12 relative to the decorative housing 18 so the earphone 10 can be manipulated by the decorative housing 18 when inserting and removing the earphone 10 from a user's ear.

Figure 6:
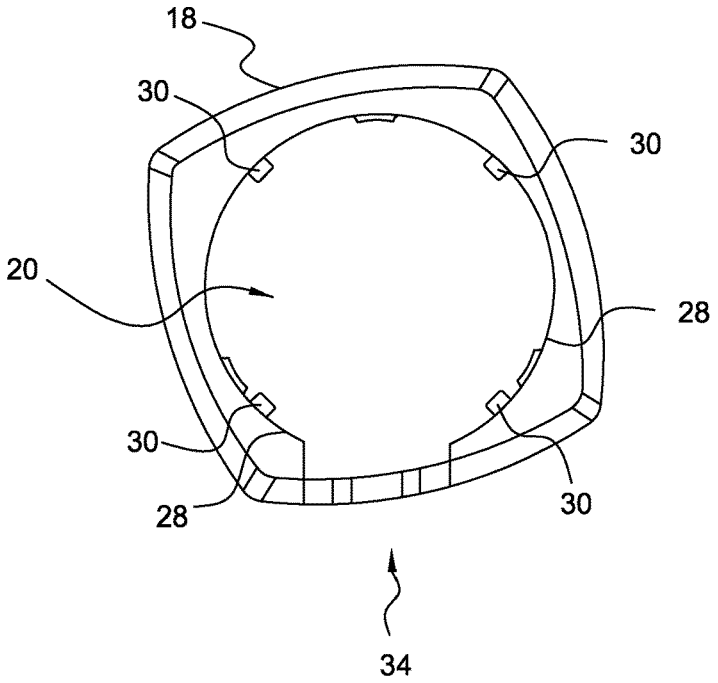
FIG. 6 is a front view of the housing showing an opening.

Referring to FIG. 6, a front view of the decorative housing 18 is shown. Due to the slot 34 being incorporated into the opening 20, the opening 20 can enlarge slightly under pressure as the body portion 12 (not shown) is inserted, causing the decorative housing 18 to lock onto the body portion 12 by virtue of the lip 28 "clicking" into the channel 26 (not shown) of the earphone 10. Also shown in this view, the stabilizing members 30 face inward from the decorative housing 18, positioned to receive the body portion 12 of the earphone 10.

Figure 7:
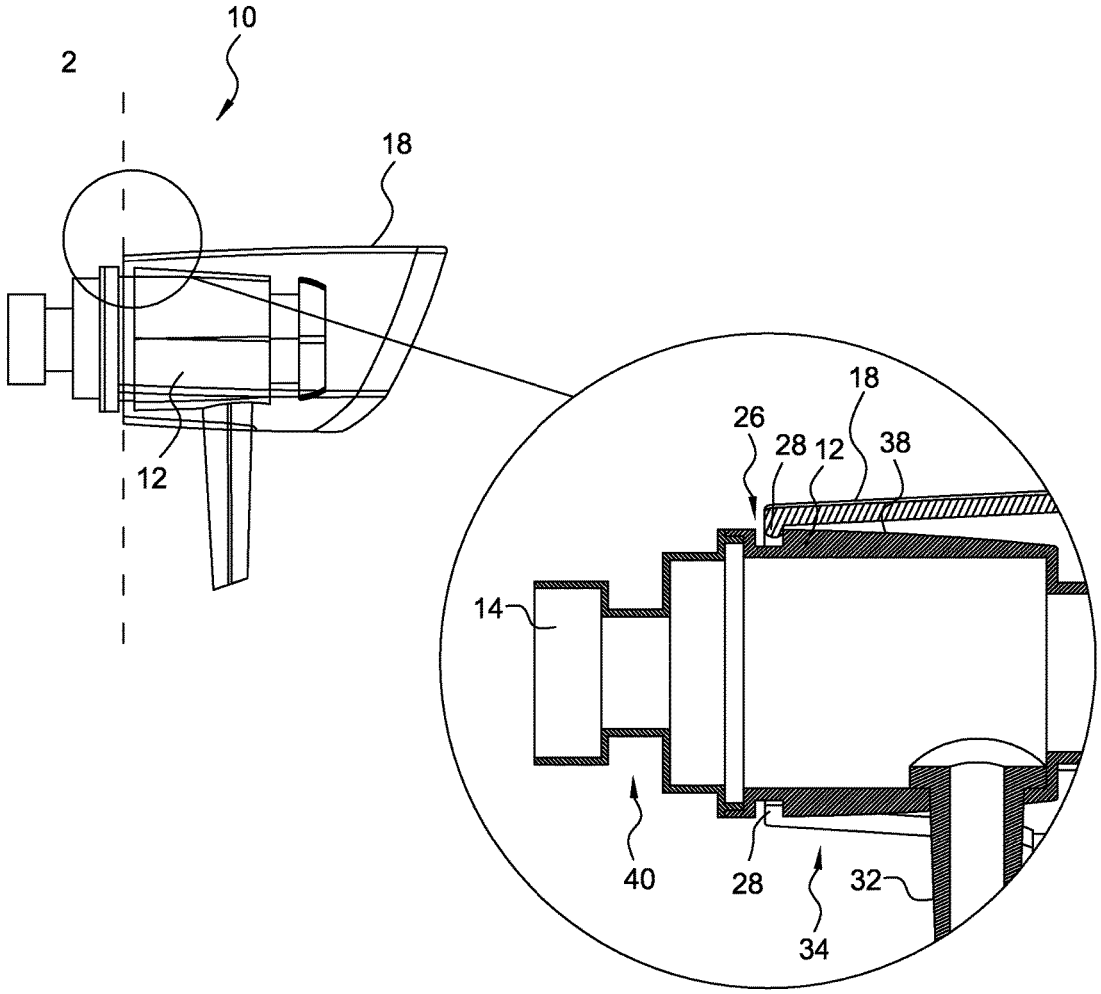
FIG. 7 is a side view of the housing installed on the earphone, including a cutaway detail view of a connection between the decorative housing and the earphone.

In FIG. 7, the earphone 10 is shown in side view with the decorative housing 18 installed on the body portion 12. A callout and cutaway view shows the connection between the body portion 12 and the decorative housing 18. As the decorative housing 18 is urged over the body portion 12, the body portion 12 slides into the decorative housing 18 and the cable strain-relief 32 slides into the slot 34 as the lip 28 engages the slot 26.

The body portion 12 is sized slightly larger than the opening 20, such that the body portion 20 abuts the lip 28 before being fully inserted into the decorative housing 18. This causes the opening 20 to expand under pressure until the lip 28 reaches the channel 26, at which time the lip 28 "clicks" into place, restoring the opening 20 to its original size, and affixing the body portion 12 to the decorative housing 18 in a collar-like fit. To prevent further movement, the stabilizing members 30 are sized to engage the body portion 12 just as the lip 28 engages the channel 26. In this manner, the releasable connection 22 between the body portion 12 and the decorative housing 18 achieves a tight yet removable "click" fit.

To use the earphone 10, a user selects a decorative housing 18, preferably from among an available selection of decorative housings having different ornamental characteristics. The selected decorative housing 18 is slid over the body portion 12 until the releasable connection 22 "clicks" in place. The earphone 10 may then be used in the manner of a conventional set of in-ear earphones. When a user desires a different look, the user simply "clicks" the installed decorative housing 18 off of the body portion 12, selects a different decorative housing 18 and installs it on the body portion 12. In one contemplated embodiment, the outer appearance of the body portion 12 may comprise its own aesthetically pleasing design. In this manner, in addition to employing various decorative housings, a user may elect to use the earphone 10 just by itself.

Referring to FIGS. 8 through 18, a new, secondary alternative embodiment of the earphone 100 is shown and described.

Figure 8:
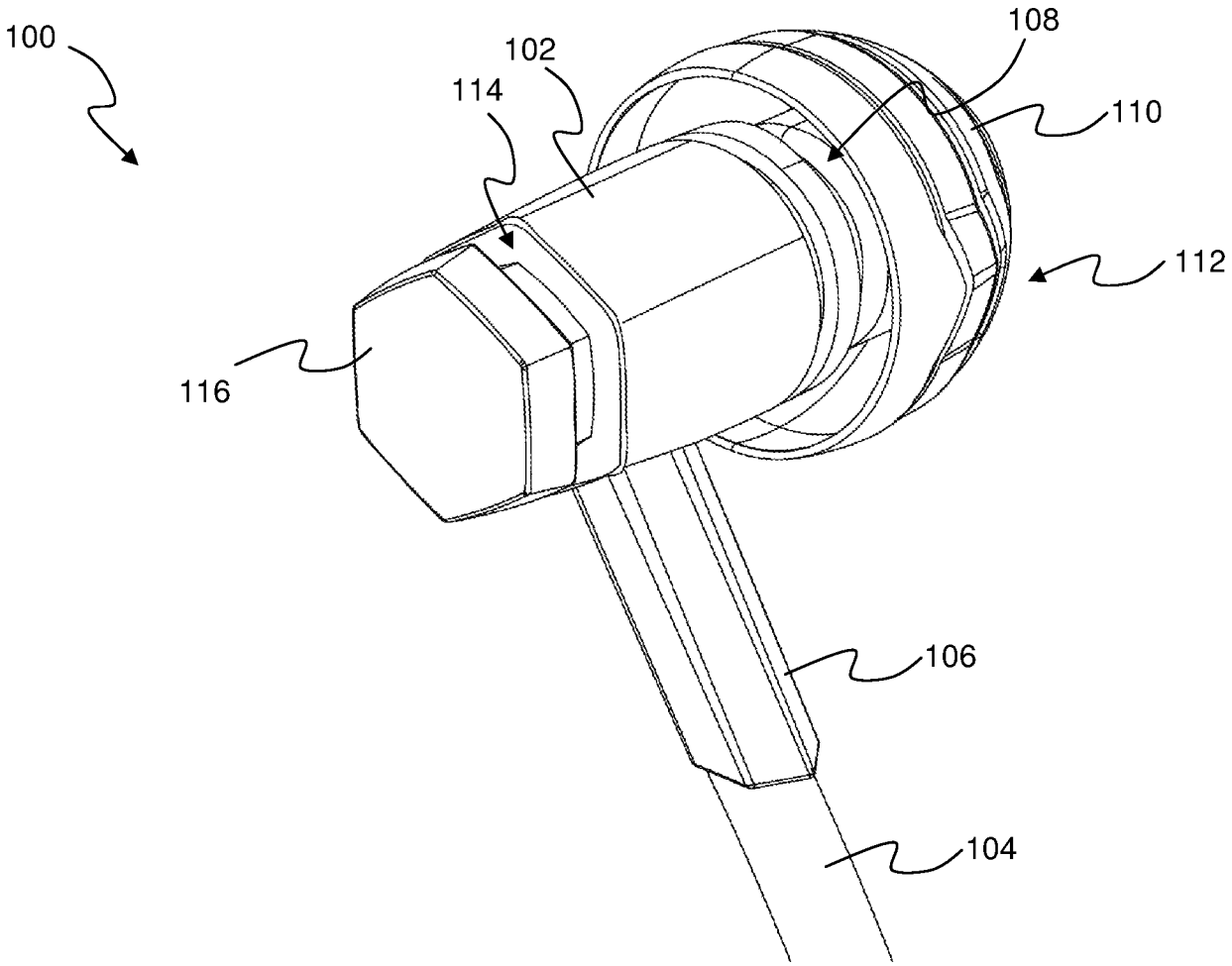
FIG. 8 is a perspective view of an alternative embodiment earphone for interchangeable housings.

FIG. 8 shows the earphone 100, without a housing attached. The earphone 100 is designed to present an attractive appearance while incorporating features allowing users to customize the earphone according to use and preference. The earphone 100 has the basic features common to virtually all earphones, such as a body 102, a cable 104, a cable strain relief 106, and a sound port 108. An ear tip 110, typically made of more flexible silicon than the housing (not shown) and interchangeable to accommodate differently sized ear canals is also included and may have ear tip indicia 112 incorporated therein to present a cohesive decorative appearance, and for branding.

Still referring to FIG. 8, in addition to conventional features, the earphone 100 also includes features necessary for supporting several interchangeable housings. The most prominent of these features is a channel 114 encircling the body 102 near the back end 116 of the body 102 opposite the sound port 108 and aft of the strain relief 106. The body 102 is sized and shaped for a reduced profile relative to the ear tip 110, allowing the interchangeable housings to convey the illusion that the housings are the exterior of the body 102. One manner of accomplishing such an illusion is to provide a body 102 sufficiently small in circumference to allow the tip 110 to align with the surface of an interchangeable housing.

Still referring to FIG. 8, in addition to allowing users to mount interchangeable housings on the body 102, the earphone 100 is designed to present an attractive appearance with no housing at all, in effect, providing an additional decorative design of the earphone 100 available to a user. In the illustrated embodiment, the body has a sloped hexagonal profile of reducing circumference from adjacent the sound port 108 to the back end 116. Although the channel 114 incorporated into the body 102 interrupts the body 102 profile, the back end 116 continues the profile arc of the body 102, thereby presenting a uniform and aesthetic appearance. In some embodiments, the back end 116 may have trademark indicia (not shown) or other design features allowing the earphone 100 to appear complete without an interchangeable housing mounted thereon.

Figure 9B:
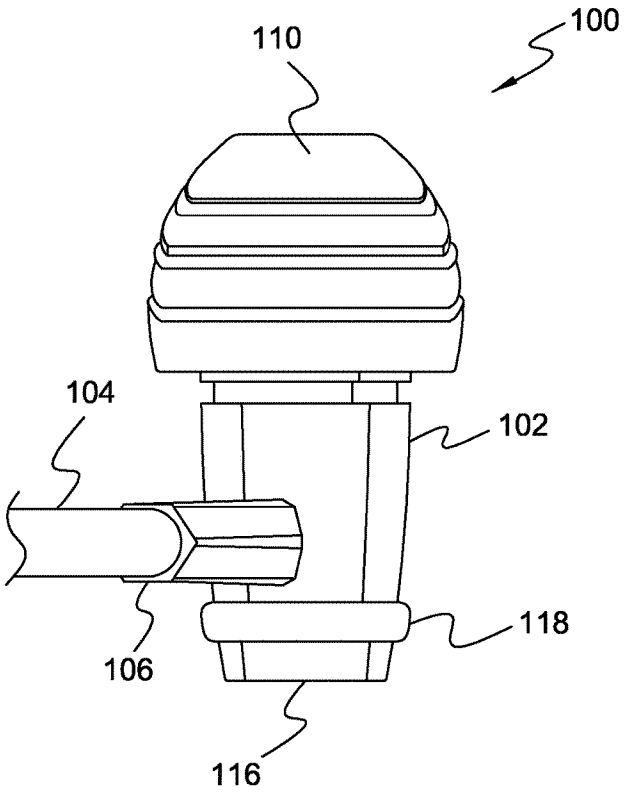
FIGS. 9A and 9B are bottom views, respectively of the earphone, preparing to accept a retaining ring, and having a retaining ring mounted thereon.
Figure 9A:
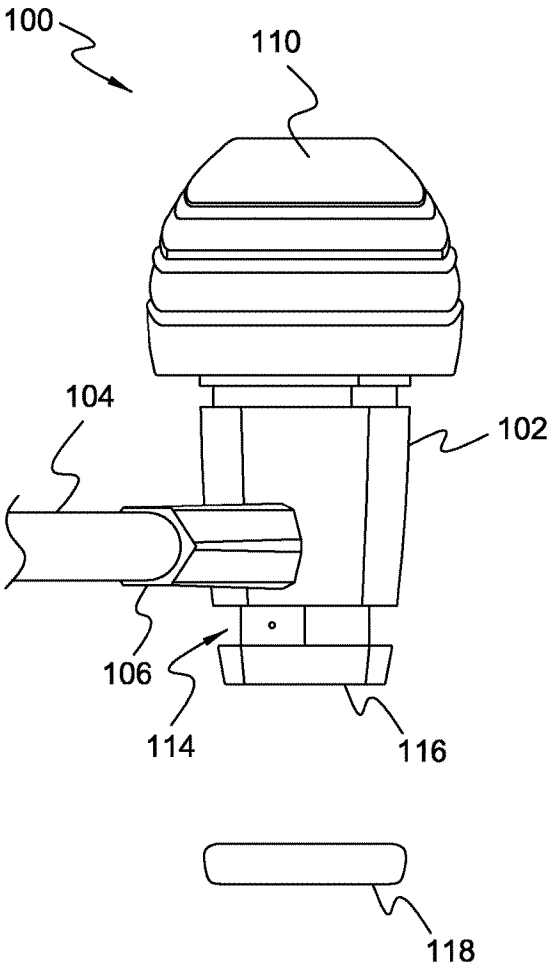

Referring to FIGS. 9A and 9B, the primary means for the earphone 100 to engage an interchangeable housing (not shown) is through the use of a resilient retaining ring 118. Referring to FIG. 9A, the retaining ring 118 is separable from the housing 102 and may be provided separately when the earphone 100 is purchased. The retaining ring 118 is preferably made of a resilient material such as rubber or rubberized silicone to prevent slippage of the retaining ring 118 against the housing (not shown).

Referring to FIG. 9B, the retaining ring 118 engages the housing 102 by stretching over the back end 116 and seating in the channel 114 (FIG. 8A). Preferably, when the retaining ring 118 is disposed in the channel 114, the retaining ring 118 extends beyond the housing 102, thereby presenting a resilient non-slip surface capable of engaging and retaining an interchangeable housing (not shown) placed thereon by an interference fit. In one embodiment, the retaining ring prevents the interchangeable housing from contacting the body 102 thereby preventing scratching when installed. The retaining ring 118, when properly seated, is preferably aft of the cable 104 and cable strain relief 106 for ease of installation and removal.

Figure 10:
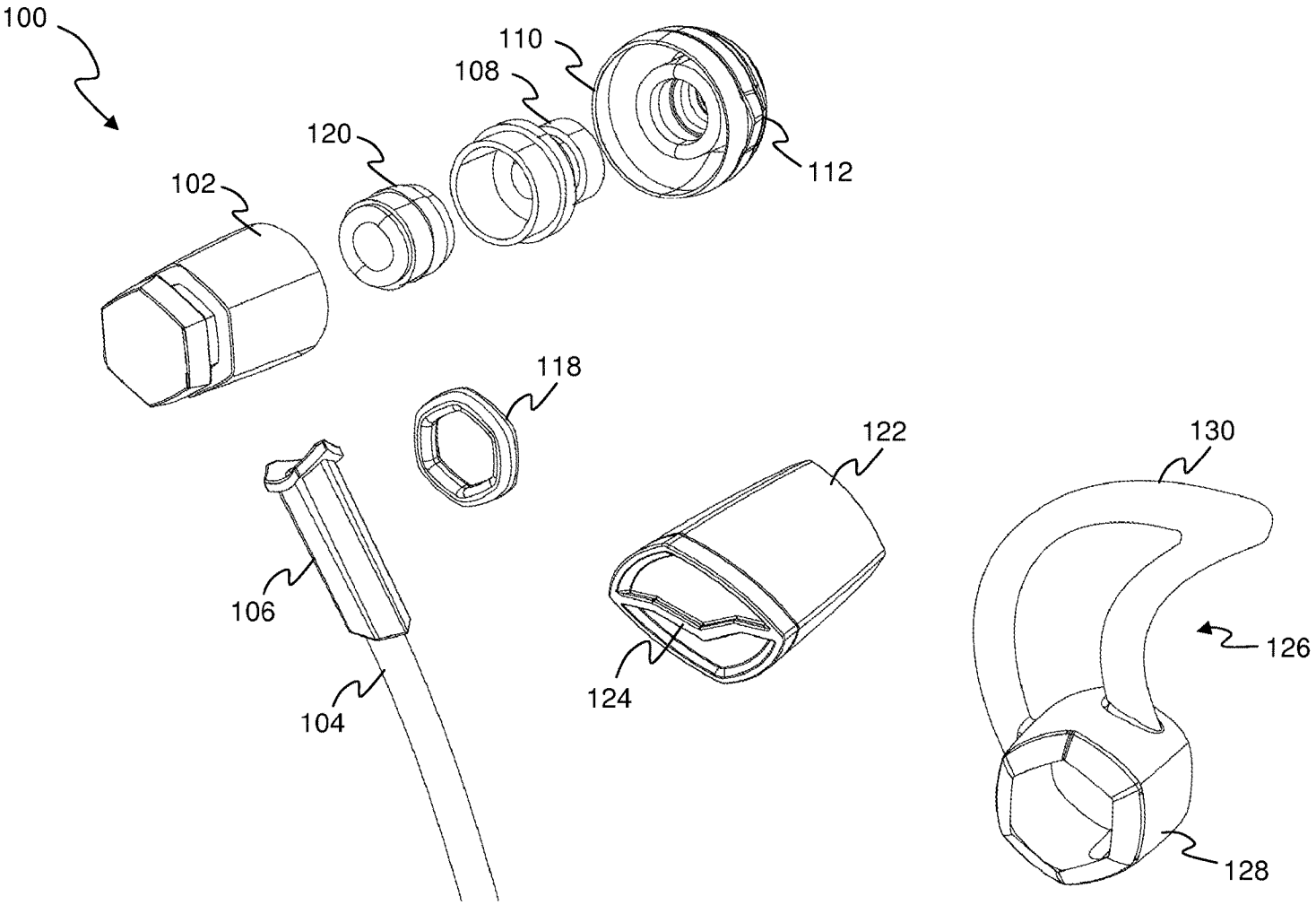
FIG. 10 is an exploded view of the earphone showing alternative interchangeable housings: a decorative housing and a sport fin housing.

Referring to FIG. 10, an exploded view of the earphone 100 is shown, including basic component parts such as the body 102, cable 104, strain relief 106, sound port 108 and tip 110. In this view the transducer 120, which is customarily housed within the body 102, is held in place by the sound port 108. The retaining ring 118 is also shown. Two exemplary interchangeable housings, a decorative interchangeable housing 122 and a sport fin 126 are also shown as alternative coverings of the earphone 100, but are not required.

The decorative interchangeable housing 122 represents a purely decorative housing for providing a suitable aesthetic appearance to the earphone 100. It may be of virtually any ornamental shape a user's ear can accommodate when the ear tip 110 is inserted therein. The decorative housing 122 may also correspond to other design features (such as the ear tip indicia 112 of FIG. 7) for a matching appearance. The sport fin interchangeable housing 126 comprises a fin member 130 adapted to engage a user's ear (not shown) for holding the earphone 100 tightly in place during activities involving exertion and movement. The fin member 130 extends from a sport housing 128, which affixes to the body 102.

Figure 11C:
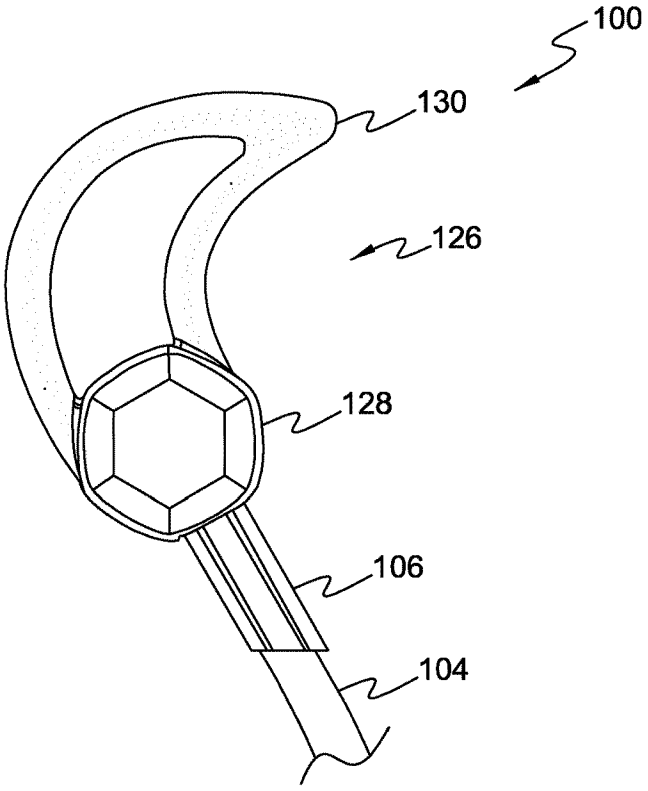
FIGS. 11A, 11B, and 11C are rear views of the earphone with no housing, the earphone with a decorative housing, and the earphone with a sport fin, respectively.
Figure 11B:
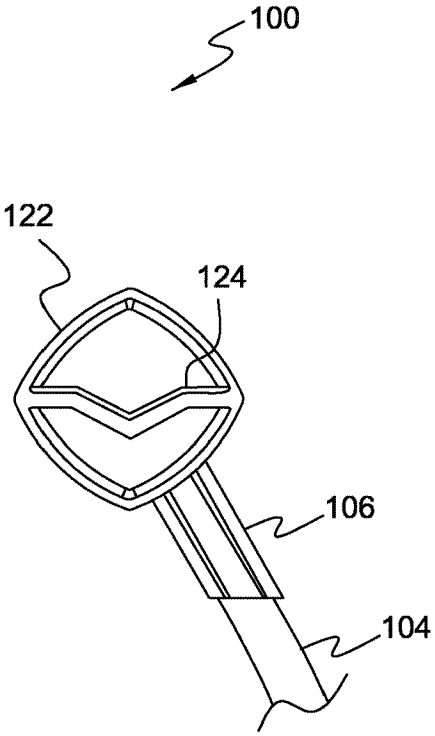
Figure 11A:
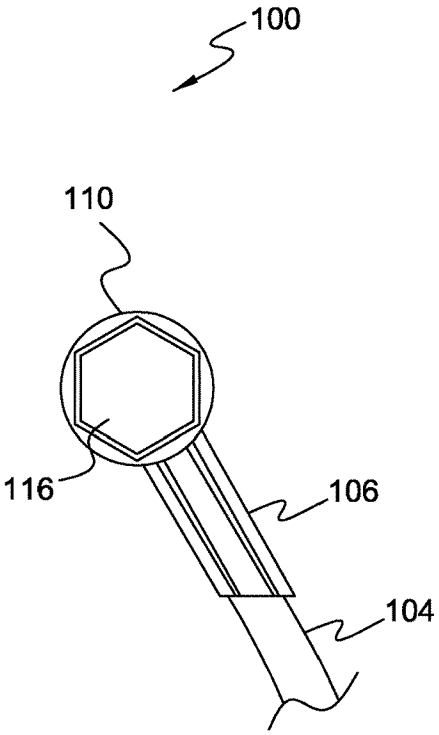

Referring to FIGS. 11A, 11B and 11C, three headphones, very different in function and appearance may be easily created with the present invention. FIG. 11A shows an earphone 100 with no housing, as it would appear when inserted into a user's ear (not shown). In this embodiment, the earphone 100 has a reduced profile, but retains a decorative appearance (i.e., a hexagon) at the back end 116, which would be apparent to persons viewing the earphone 100. Referring to FIG. 11B, an earphone 100 with a decorative housing 122 is shown. In this view, the decorative housing 122 would visibly extend from the user's ear. Additionally, decorative housing indicia 124 covering the back end 116 (not shown) may display a logo or other identifiable pattern.

Referring to FIG. 11C, an earphone 100 with a sport fin interchangeable housing 126 is shown. The sports fin interchangeable housing 126, fits closely over the earphone 100. Designed principally for jarring or motion based activities, the sport housing 128 is complimentary to the earphone 100 body portion 102 for secure anchoring. The fin member 130 extends from the sport housing 128 in an orientation placing it opposite the cable strain relief 106 in order to more securely anchor the fin member 130 in the user's ear.

Figure 12A:
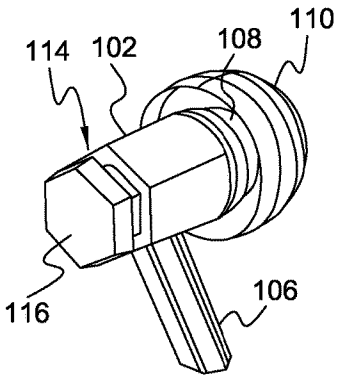
FIGS. 12A through 12F are perspective views of the earphone having a variety of different housings and housingless appearances.
Figure 12B:
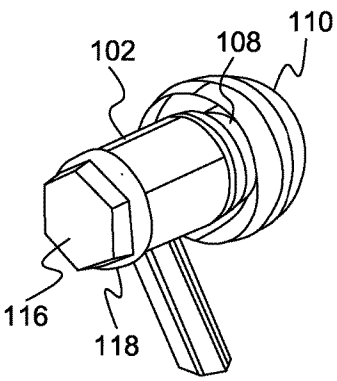
Figure 12C:
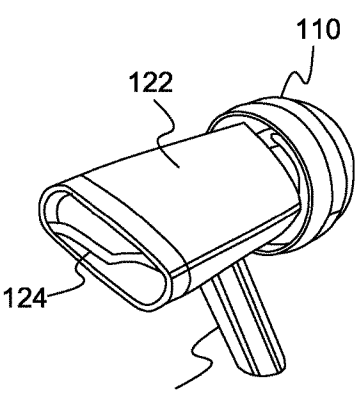

Referring to FIGS. 12A through 12F, six alternative designs are shown. FIG. 12A shows the most basic embodiment of the earphone 100, which, while fully functional, is only decorative in its ordinary appearance, comprising principally the body portion 102 and back end 116. FIG. 12B shows the headphone with a retaining ring 118 inserted over the back end 116 and into the channel 114. Although the retaining ring 118 is principally functional, it may be employed as a decorative feature, should a user decide to cover the channel 114. Referring to FIG. 12C, with the retaining ring 118 (not shown, see FIG. 11B) in place on the body portion 102 (not shown), the decorative interchangeable housing 122 may anchored securely in place for a decorative appearance.

Figure 12D:
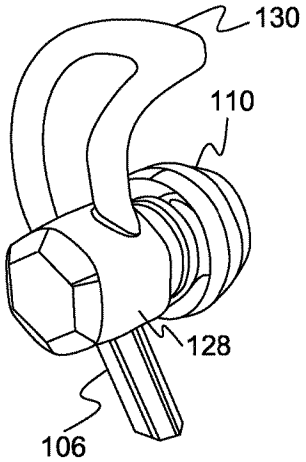
Figure 12E:
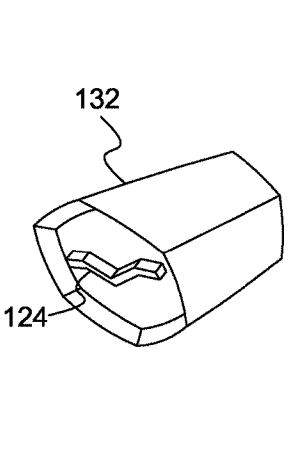

FIG. 12D shows the earphone 100 with the decorative interchangeable housing 122 replaced with the sport fin interchangeable housing 126 as shown in FIG. 10C. FIG. 12E shows a second embodiment decorative interchangeable housing 132. It is anticipated that users may desire many different designs from which to choose when customizing the earphone 100. For this reason, multiple decorative housings may be included with the earphone 100 packaging. The second embodiment decorative interchangeable housing 132 includes a different profile and different indicia 124 which may be chosen according to preference.

Figure 12F:
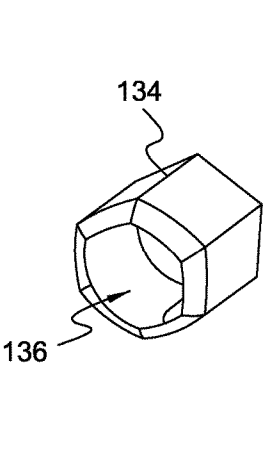

FIG. 12F shows a third embodiment decorative interchangeable housing 134 of a type adapted for closely fitting to the earphone 100 (not shown). The third embodiment decorative interchangeable housing 134 has a profile similar to the earphone, but may be created in a different color or material, thereby changing the look of the earphone 100 according to preference. In particular, multiple third embodiment decorative interchangeable housings 134 may accompany the earphone 100, allowing a user to choose between numerous colors, and alternative materials, such as metal or textured plastic. The illustrated embodiment also includes a hollow backend 136, which allows the hexagonal profile of the body portion 102 (not shown) to be visible. By making some third embodiment decorative interchangeable housings 134 with a hollow backend 136 and some without, additional designs are possible.

Figure 13C:
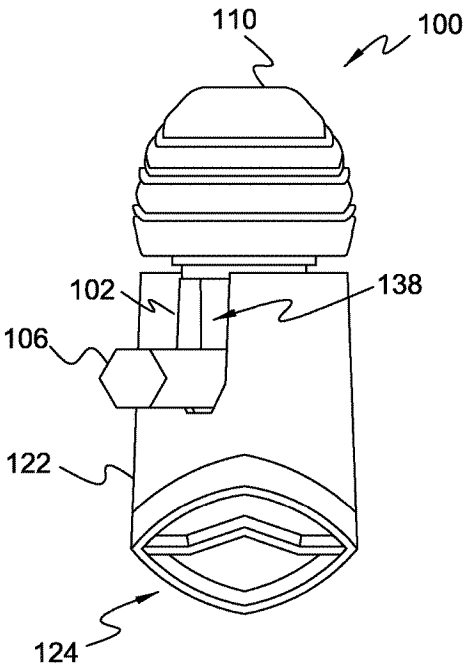
FIGS. 13A, 13B, and 13C are bottom views, respectively, of the earphone before, during, and after installation of a housing.
Figure 13B:
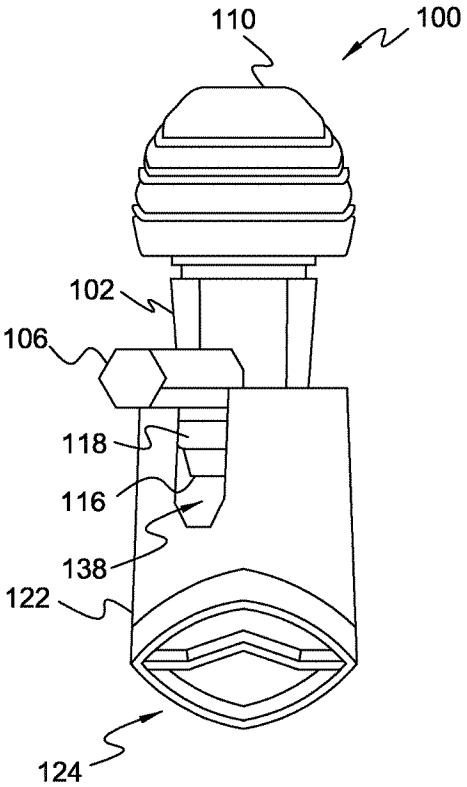
Figure 13A:
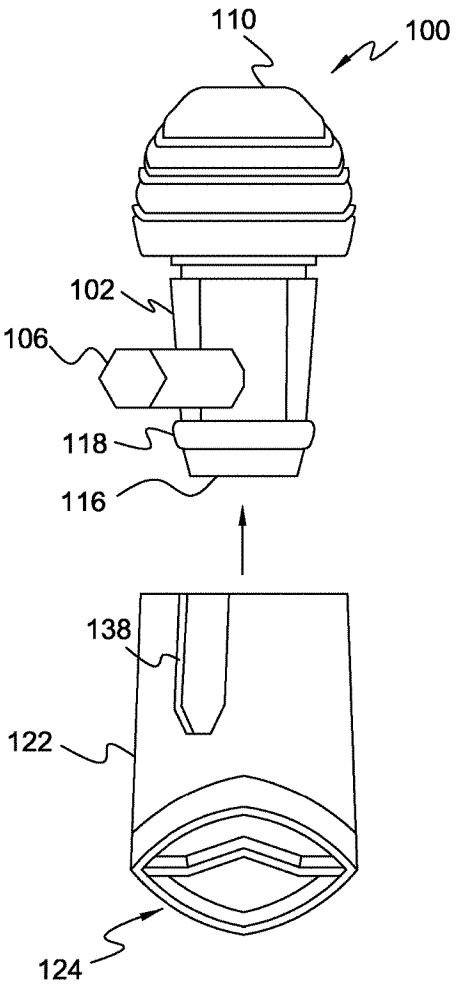

FIGS. 13A, 13B, and 13C show the steps involved in customizing the earphone 100. Referring to FIG. 13A, a user first selects the housing, such as a decorative housing 122. The decorative housing 122 is oriented relative to the earphone 100 such that the cable strain relief 106 aligns with a slot 138 in the decorative interchangeable housing 122. Referring to FIG. 13B, as the decorative interchangeable housing 122 is brought over the body portion 102, the slot engages the cable strain relief 106. This not only allows the cable strain relief to function in its customary manner, it also provides an orientation and guide so that any of the housings engage the earphone 100 predictably each time they are installed. Referring to FIG. 13C, preferably the slot is sized such that the cable strain relief reaches the end of the slot 138 at the same time the decorative interchangeable housing 122 becomes fully engaged on the earphone 100.

Figure 14B:
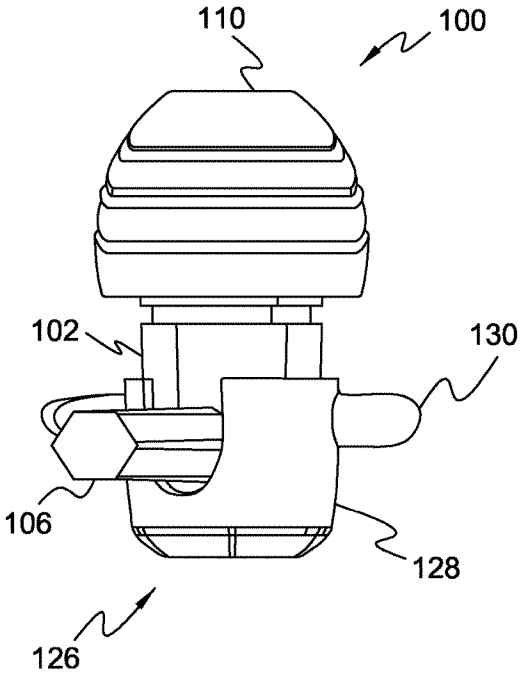
FIGS. 14A and 14B are bottom views, respectively, of a sport fin before and after installation on the earphone.
Figure 14A:
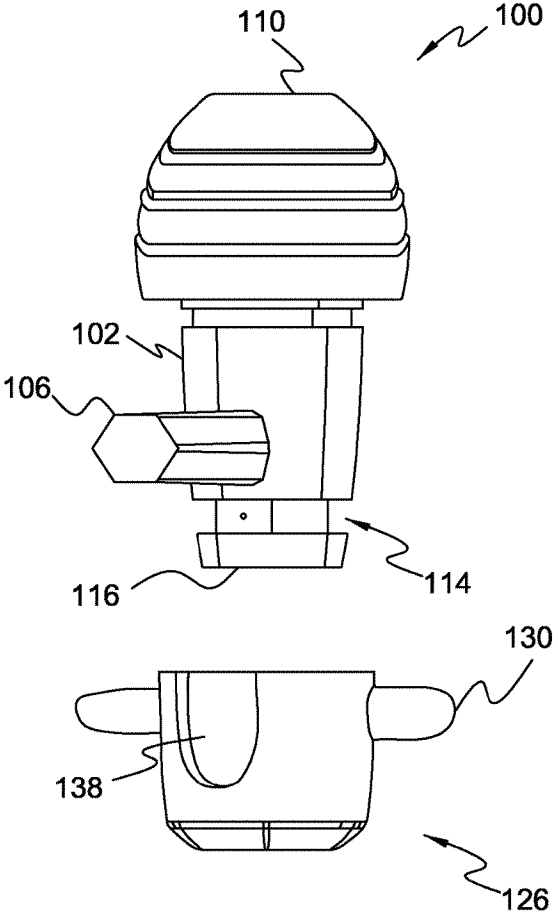

Referring to FIGS. 14A and 14B, the sport fin housing 126 is shown being inserted onto the earphone body 102. In order to effectively engage a user's ear, the fin member 130 is oriented opposite the slot 138, so that the cable strain relief 106 depends downward away from the earphone 100 while the fin member 130 extends upward. Preferably, the sport housing 128 will have a complimentary shape to the body portion 102 to help anchor it in position.

Figure 15B:
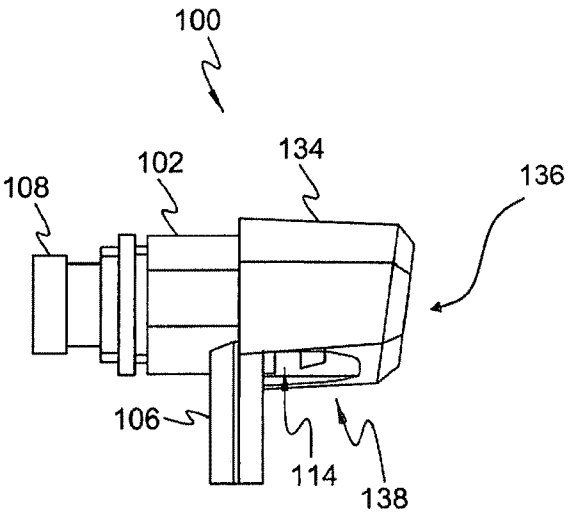
FIGS. 15A, 15B, and 15C are side views, respectively, of the earphone with a housing having a rear opening before, during, and after installation.
Figure 15C:
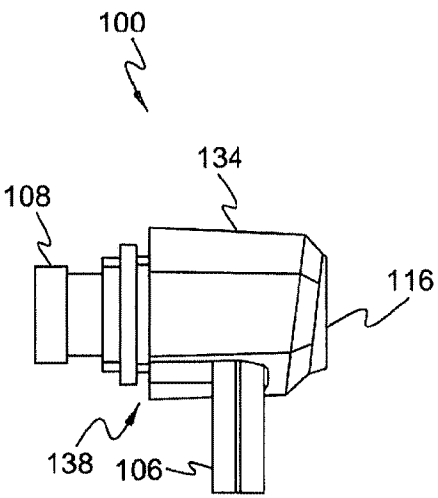
Figure 15A:
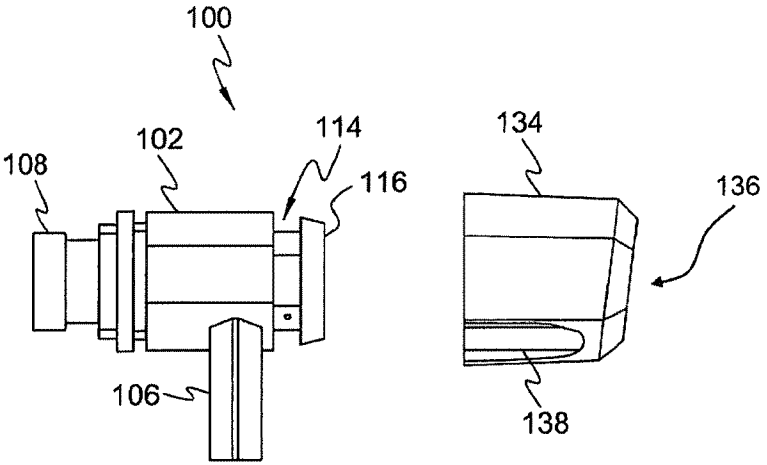

Referring to FIGS. 15A, 15B and 15C, the third embodiment decorative interchangeable housing 134 is shown being inserted onto the earphone 100. While the retaining ring 118 (not shown) is omitted in the exemplary view, it is anticipated that it may be included for a more secure fit between the third embodiment decorative housing 134 and the earphone 100. In the illustrated embodiment, the hollow backend 136 serves as the anchoring mechanism. Referring to FIG. 15B, as the earphone 100 and third embodiment decorative housing 134 are brought together, the cable strain relief 106 aligns with the slot 138 in a manner that aligns the hollow backend 136 with the back end 116.

Referring to FIG. 15C, when the hollow backend 136 of the housing 134 and the backend 116 of the body 102 align, the backend 116 extends out of the housing 134. This provides a strong anchoring connection (in addition to the retaining ring 118 if included), and also creates a new decorative appearance for the earphone 100.

Figure 16:
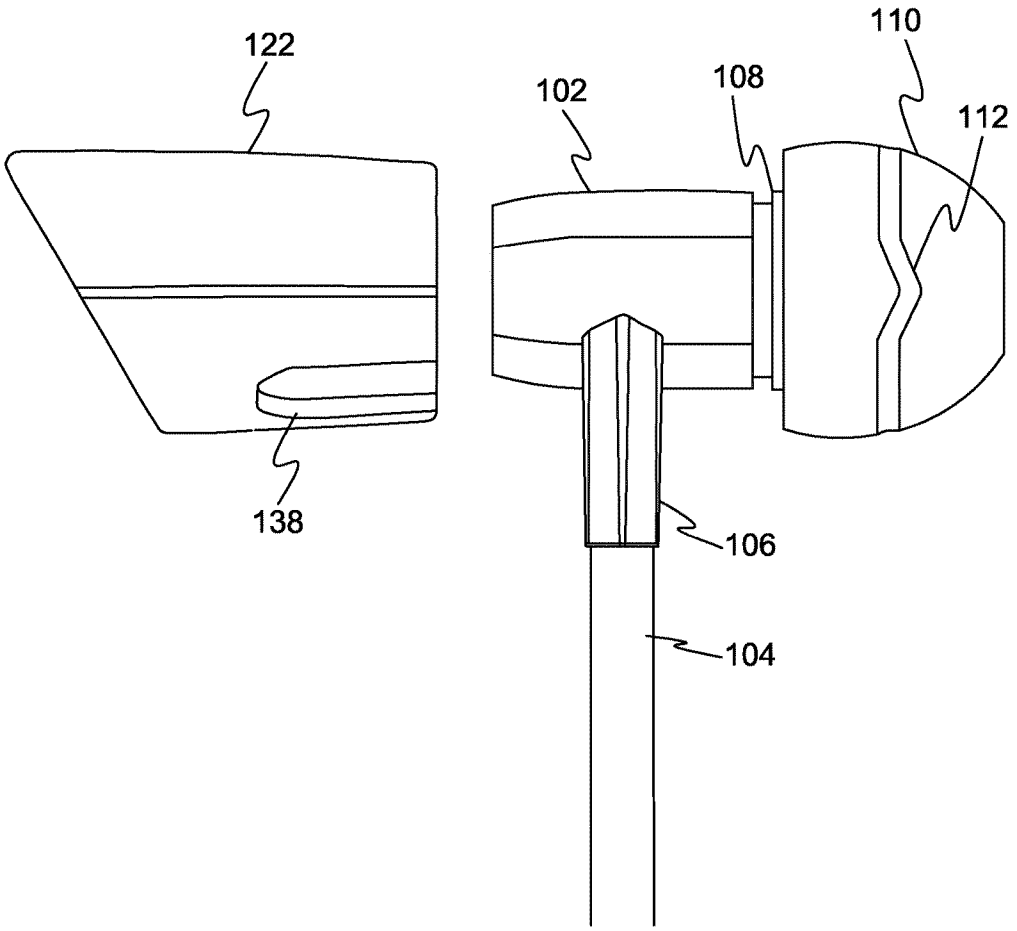
FIG. 16 shows the earphone with a removable housing made of resilient silicon, obviating the need for a separate coupling structure.

Referring to FIG. 16, due to the resiliency, durability and non-scratching nature of some materials, it may not be necessary to have a discrete anchoring mechanism, such as the retaining ring 118. In these instances, only a pressure fit is necessary to keep a housing, such as the decorative housing 122 engaged on the earphone 100 body 102. Because the strain relief 106 engages a channel 138 on the decorative housing 122, additional anchoring is achieved.

An added benefit of such an arrangement is that only one portion (i.e., the housing 122 or the body 102) needs to be made of non-scratching material. The arrangement allows for example a metal earphone body 102 to be covered by a silicon-based decorative housing 122 without scratching the body 102. Although the pressure fit of a non-scratching material such as resilient silicon is frequently sufficient for desired anchoring, that does not preclude such an embodiment from also having a resilient ring 118 (not shown), a clip (not shown) or other structures that assist in anchoring the housing 122 to the body 102.

Figure 17A:
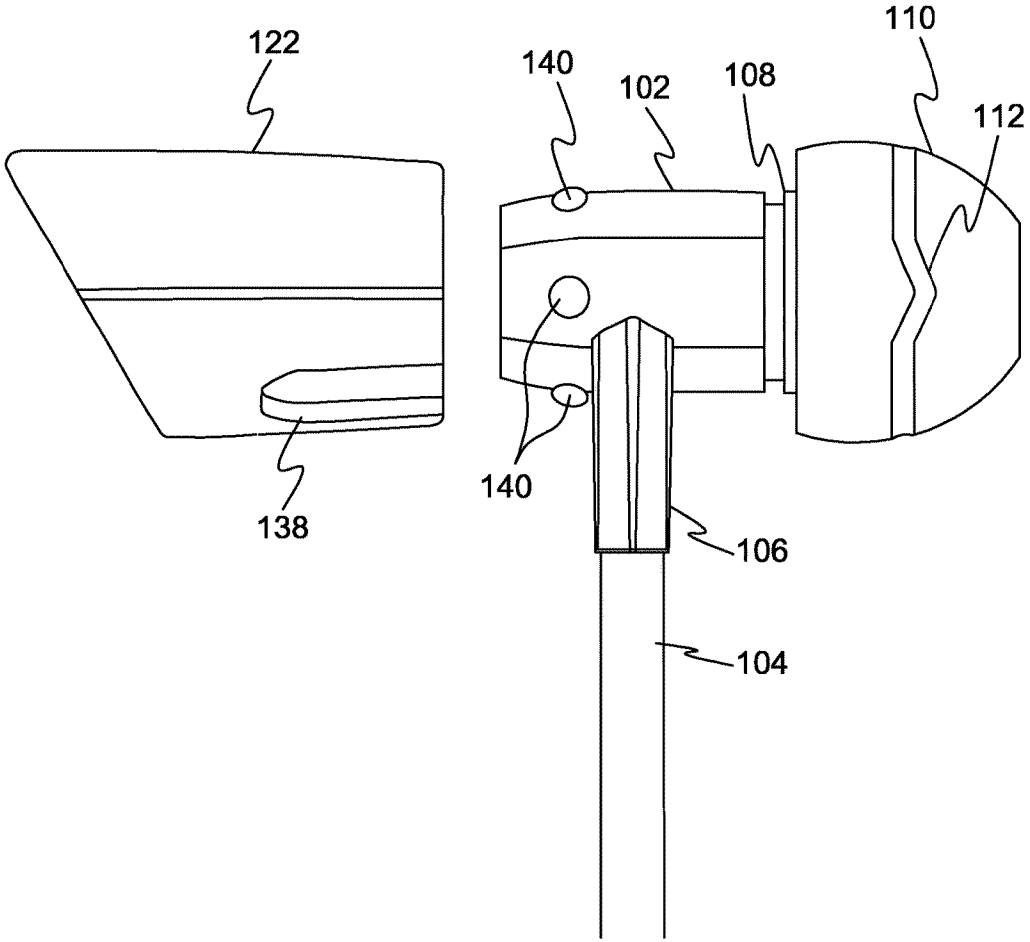
FIGS. 17A and 17B show a side view and a rear view, respectively, of an alternative embodiment having anchoring dots on the earphone body.
Figure 17B:
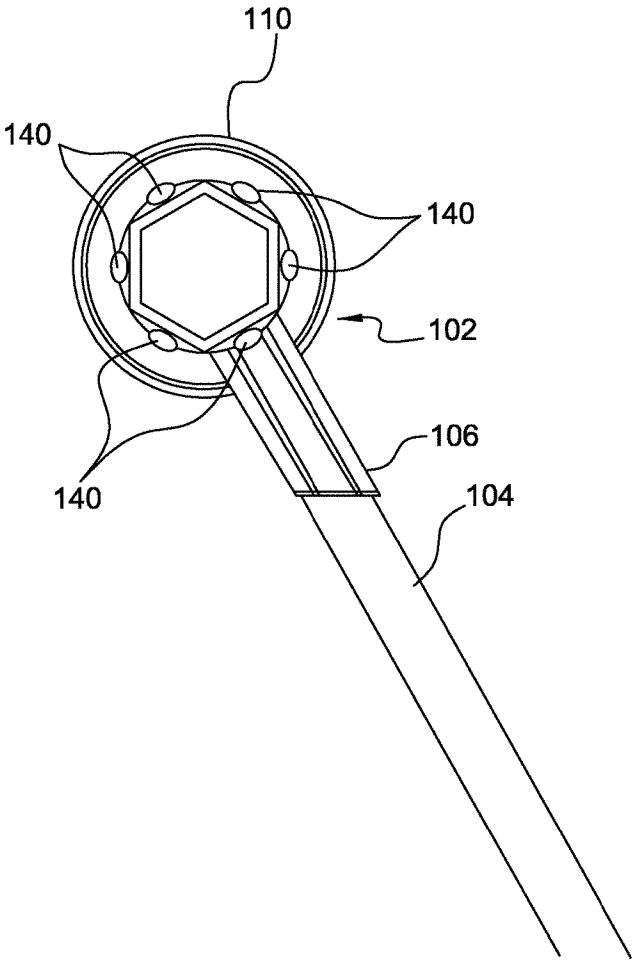

Referring to FIGS. 17A and 17B, although the exemplary embodiment includes a resilient ring 118 adapted to fit in a channel 114, the anchoring mechanism can be any sufficiently soft, yet resilient material disposed between the housing 122 and the body 102. In one embodiment, the resilient ring 118 may be permanently installed on the body, in a manner similar to that shown in FIG. 8B. Additionally, silicon or other rubbery material may be disposed on the earphone body 102. For example, dots 140 of robbery material could be included around the body 102, each dot 140 engaging an interior portion of the housing 122.

Figure 18:
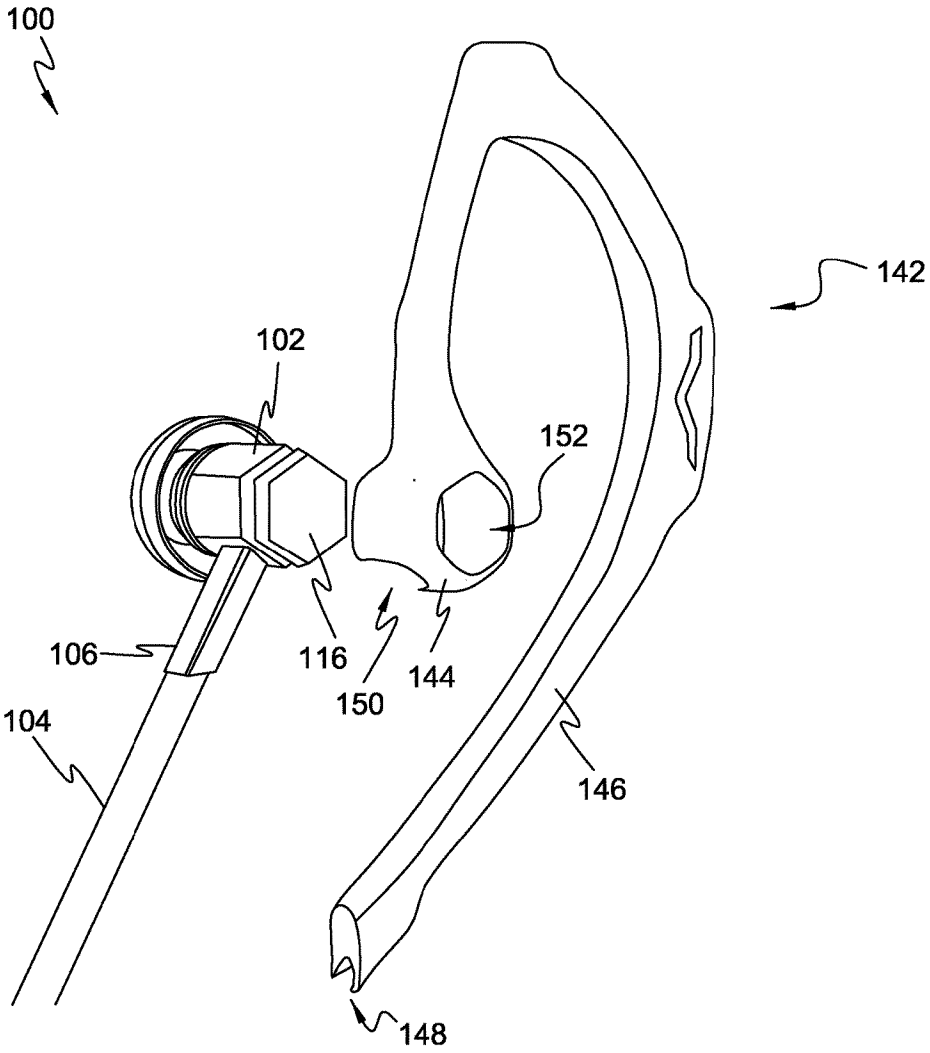
FIG. 18 is a perspective view of a housing having an ear hook prior to installation on the earphone.

Referring to FIG. 18, another embodiment of the earphone 100 incorporates an ear hook-type housing 142. In this embodiment, the ear hook housing 142 includes a housing portion 144 and an ear hook member 146 for travelling around a user's ear (not shown). The ear hook member 146 may include an anchor 148 for holding the cable 104 of the earphone 100. In addition to the ear hook member 146, the ear hook housing 142 includes a housing portion 144 adapted to closely engage the body 102 of the earphone 100. The housing portion 144 anchors the ear hook housing 142 relative to the body in three ways.

First, the housing portion 144 is anchored on the body 102 using an anchoring mechanism such as the resilient ring 118, silicon dots 140, or by virtue of being made of resilient and durable silicon or a similar material. Second, the housing portion 144 includes a slot 150 that engages the strain relief 106 where it exits the body 102, preventing the housing portion 144 from aiming relative to the body 102. Finally, the housing portion 144 may have a hollow end 152 through which the body 102 protrudes. When the cable relief 106 is in the slot 150, a portion of the body 102 protrudes through the hollow end 152. Unless the portion of the body 102 protruding through the hollow end 152 is round, a connection between the two will also resist movement of the body 102 relative to the housing portion 144.

To use the earphone 100, a user may simply insert the earphone 100 into the user's ear, plug in the earphone 100 and listen. Alternatively, the user may add the step of installing the retaining ring 118 on the earphone 100 for a slightly different appearance. For a more decorative appearance, the user may additionally install one of several decorative interchangeable housings 122 or a sport fin interchangeable housing, to provide either a purely decorative unique design for the earphone 100 or for engaging in sports.

If a decorative design is desired, a second embodiment decorative interchangeable housing 132 or a third embodiment decorative interchangeable housing 134, including one with a hollow back end 136 may be employed as desired. To achieve maximum customization, it is anticipated that the earphone 100 will be sold with numerous housings of different types, allowing users to mix and match housings according to preference, and will be easily customizable, allowing users to create their own designs using a web-based, or other graphic interface.

The foregoing description of the preferred embodiment of the Invention is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. An insertable earbud-type earphone customizable into a variety of shapes, comprising:

a body portion, the body portion enclosing a transducer;

a sound port extending from the body portion, the sound port sized for insertion into a user's ear canal;

a decorative first housing member configured to slide on to and enclose the body portion up to the sound port;

the body portion and the housing member releasably engaged in a resilient coupled relationship; and further comprising a decorative second housing having an appearance different than the first housing, the second housing configured to slide onto and enclose the body portion up to the sound port when installed in place of the first housing.

2. The earphone of claim 1 wherein the body portion is releasably coupled to the housing by pressure fit.

3. The earphone of claim 1 further comprising a resilient elastic member on the outside of the body portion, coupling the body portion to the housing.

4. The earphone of claim 1 further comprising a resilient elastic member in a channel on the outside of the body portion.

5. The earphone of claim 1 further comprising a resilient elastic member on an inner surface of the housing.

6. The earphone of claim 1 wherein the body portion includes a front end proximal to the sound port and a rear end distal from the sound port.

7. The earphone of claim 6 wherein the housing engages the body portion proximal to the front end.

8. The earphone of claim 6 wherein the housing engages the body portion proximal to the rear end.

9. The earphone of claim 1 wherein the housing comprises an anchoring fin, shaped to engage a user's ear.

10. The earphone of claim 9 wherein the housing comprises an elastic member on an interior side of the housing.

11. The earphone of claim 1 wherein the housing comprises an ear hook for engaging a user's ear.

12. The earphone of claim 11 wherein the housing comprises an elastic member on an interior side of the housing.

13. The earphone of claim 11 wherein the ear hook comprises a cable pass-through.

14. The earphone of claim 1 wherein the housing comprises decorative indicia.

15. The earphone of claim 1 wherein the housing comprises a slot for accommodating a cable strain relief extending from the body portion.

16. The earphone of claim 1 wherein the housing includes an opening through which a rear section of the body portion extends opposite the sound port.

17. An in-ear earphone having a removable and interchangeable housing, comprising:

a body portion containing a transducer and having a cable strain-relief;

a nozzle portion extending from the body portion, the nozzle portion sized to extend into a user's ear canal, the nozzle including a sound port and configured to receive a deformable tip;

a housing having an opening sized to enclose the body portion in a pressure fit, the housing having a slot adjacent the opening, the slot sized to accommodate the cable strain relief; and wherein the housing member is held against the body portion in a pressure fit, thereby anchoring the housing to the body portion when the body portion is inserted into the housing.

18. A method of customizing an earphone comprising the steps of:

providing an in-ear earphone having a body portion and a nozzle portion;

providing a releasable connection between the body portion and the nozzle portion;

selecting a housing having an opening and a slot extending from the opening;

inserting the body portion through the opening until the housing is releasably affixed to the body portion and is adjacent the nozzle portion with a strain relief disposed in the slot; and inserting the in-ear earphone bearing the housing in a user's ear.

19. The method of claim 18 further comprising the step of removing the housing from the in-ear earphone by sliding the body portion out of the opening.

20. The method of claim 18 further comprising the step of sliding a second housing having an appearance different from the first housing over the body portion.

* * * * *